United States Patent [19]

Sugiyama

[11] Patent Number: 4,498,760

[45] Date of Patent: Feb. 12, 1985

[54] BLADE CLEANING APPARATUS

[75] Inventor: Takashi Sugiyama, Okazaki, Japan

[73] Assignee: Minolta Camera Kabushiki Kaisha, Osaka, Japan

[21] Appl. No.: 469,571

[22] Filed: Feb. 24, 1983

[30] Foreign Application Priority Data

Mar. 2, 1982 [JP] Japan ..... 57-33244
Nov. 24, 1982 [JP] Japan ..... 57-206802

[51] Int. Cl.[3] ..... G03G 21/00

[52] U.S. Cl. ..... 355/15; 15/256.51; 118/652

[58] Field of Search ..... 355/15, 3 R; 15/256.5, 15/256.51; 118/652

[56] References Cited

U.S. PATENT DOCUMENTS 3,848,993 11/1974 Hasiotis ..... 15/256.51 X
3,973,845 8/1976 Lindblad et al. ..... 355/15
3,992,091 11/1976 Fisher ..... 355/15
4,026,648 5/1977 Takahashi ..... 355/15
4,152,067 5/1979 Kubota ..... 355/15
4,264,191 4/1981 Gerbasi et al. ..... 355/15
4,334,766 6/1982 Sugiyama et al. ..... 355/15

FOREIGN PATENT DOCUMENTS 91270 7/1981 Japan ..... 355/15
167172 12/1981 Japan ..... 355/15

*Primary Examiner*—R. L. Moses
*Attorney, Agent, or Firm*—Wenderoth, Lind & Ponack

[57] ABSTRACT

A blade cleaning apparatus which has a blade for cleaning a member moving past the blade and having residual toner deposited on its surface. The cleaning is achieved by removing the residual toner from the surface by holding the edge of the cleaning blade in pressing contact with the surface. The blade edge is adapted to be pressed against the surface of the member to be cleaned by a damper, whereby the blade edge is prevented from vibration during the cleaning action.

10 Claims, 9 Drawing Figures

FIG.1
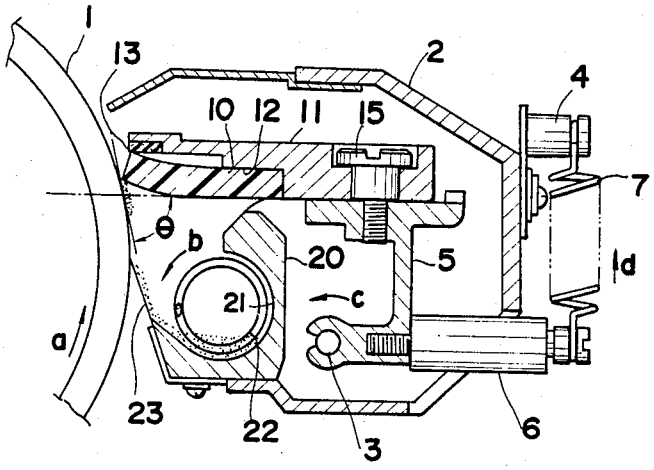
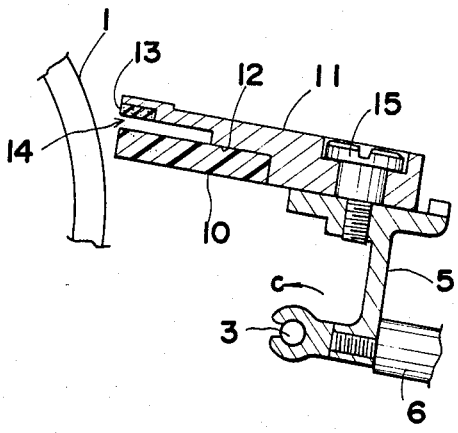
FIG.2
FIG.3
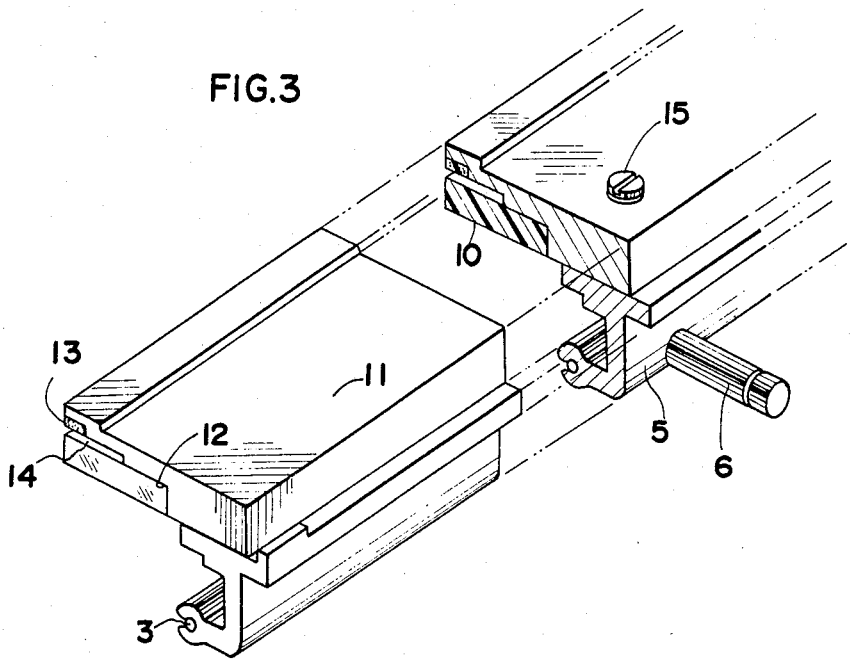

BLADE CLEANING APPARATUS

BACKGROUND OF THE INVENTION

The present invention relates to a blade cleaning apparatus, and more particularly to a blade cleaning apparatus having a blade for cleaning a member, such as the rotating photoconductive drum of an electrophotographic copying machine of the toner image transfer type, the surface of which moves past the blade with residual toner deposited therein, by removing the residual toner from the surface with the edge of the cleaning blade which is held in pressing contact with the surface.

Such a cleaning apparatus has the drawback that when the ambient temperature of the cleaning apparatus itself has risen to about 40° C., the edge of the blade is, during the cleaning operation, vibrated by the movement of the member being cleaned so as to make a noise. Accordingly, cleaning apparatuses of this type are generally provided with means to suppress the noise, for example, a vibration blocking member provided between the blade and the blade holder.

Despite the provision of such an expedient, however, it is impossible to prevent the vibration of the blade edge and, therefore, to completely eliminate the noise. Further it has been experienced that when the ambient temperature is at an elevated level of about 45° C., the noise is so loud as to give a sense of discomfort to the user.

In order to overcome this problem, an apparatus has already been proposed in which the blade holder is provided with a vibration suppressing member which transfers the vibration of the blade to the suppressing member and the vibration is suppressed by interference between the two members. Nevertheless, since the apparatus is adapted to attenuate the vibration by interference, there is a need to retain the suppressing member in a free state and also to make the suppressing member from metal or like material which has a reduced damping effect. Thus the apparatus requires a complex construction and fine adjustment, and is therefore not very useful in practice.

SUMMARY OF THE INVENTION

The main object of the present invention is to provide a novel and useful blade cleaning apparatus which overcomes the problems in the prior art blade cleaning apparatuses.

Another object of the invention is to provide a blade cleaning apparatus wherein the vibration of the blade edge can be effectively prevented by a simple arrangement.

The present invention, is based on the fact that the edge of the blade in contact with the surface of the member to be cleaned vibrates finely when generating a noise. Thus the blade cleaning apparatus of the invention is based on the principle of preventing the noise by damping the vibration of the blade edge with a damper arranged at the blade edge to contact the blade edge.

The above-stated objects and other objects of the invention are fulfilled according to the invention by a blade cleaning apparatus which comprises a cleaning blade having an edge holdable in pressing contact with the surface of the member to be cleaned which is movable past the blade with residual toner deposited on the surface which is to be cleaned therefrom, means for holding the edge of the cleaning blade in pressing contact with the surface of the member to be cleaned for removing the residual toner from the surface, a damper adapted to substantially contact the edge of the blade, and pressing means for causing the damper to press the blade edge against the surface of the member to be cleaned for substantially contacting the damper with the blade edge.

More specifically stated, the blade is made of polyurethane rubber or like elastic material and is pivotably supported by the holding means. When the cleaning apparatus is out of operation, the holding means pivotally moves the blade to move the blade edge away from and out of pressing contact with the surface of the member to be cleaned. The holding means holds the blade in pressing contact with the surface with the blade at an angle of up to 90° to the surface on the upstream side of the blade with respect to the direction of movement of the member to be cleaned.

More specifically, the damper is made of a viscoelastic material having a greater dissipation factor than the material of the blade. The pressing means brings the damper into contact with the blade edge when the blade is warped by being pressed against the surface of the member to be cleaned. The state of contact between the damper and the blade is dependent on, and varies with, the ambient temperature of the cleaning apparatus. When the ambient temperature is up to 30° C., the damper is out of contact with the blade, and the damper is brought into contact with the blade when the temperature is 41° C. or higher.

These and other objects, advantages and features of the invention will become apparent from the following description thereof taken in conjunction with the accompanying drawings which illustrate specific embodiments of the invention.

BRIEF DESCRIPTION OF THE DRAWINGS

FIG. 1 is a sectional elevation view of a first embodiment of a blade cleaning apparatus according to the invention;

FIG. 2 is an enlarged view of part of the apparatus of FIG. 1 with the blade out of contact with the drum;

FIG. 3 is a fragmentary perspective view of the blade holding means of FIG. 2;

In the following description, like parts are designated by like reference numbers throughout the several figures.

DETAILED DESCRIPTION OF THE INVENTION

Figure 4:
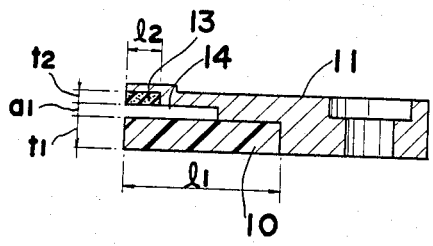
FIG. 4 is a sectional view of the blade and blade holding member thereof.

FIGS. 1 to 4 show a first embodiment of the blade cleaning apparatus according to the invention. The embodiment is incorporated in an electrophotographic copying machine of the toner image transfer type. A photoconductive drum 1 is driven in the direction of arrow a. The surface of the drum 1 which moves past the cleaning apparatus has residual toner left thereon which has not been transferred to the copy paper by the preceding step.

The cleaning apparatus generally comprises an outer casing 2, a cleaning blade 10 and a toner confining seal plate 23. The residual toner scraped off the surface of the drum 1 by the blade 10 is returned to an unillustrated developing unit by the rotation of a toner conveying coil 22 in the direction of arrow b in FIG. 1.

The outer casing 2 at a given distance from the drum 1 is attached to an unillustrated frame. A blade support member 5, which is disposed within the outer casing 2, is pivotally movable about a pin 3 fixed to the side walls of the casing 2. The blade 10 is affixed to a stepped portion 12 on the free end of blade holder 11. A damper 13 is affixed to the forward end of the holder 11 and in spaced opposed relation to the free end portion of the blade, specifically the back face of the blade 10 at the damping edge between the end surface and the back face of the blade 10. When the cleaning apparatus is out of operation, i.e., when the end portion of the blade 10, specifically the cleaning edge of the blade 10 between the front face and end surface of the blade, is out of pressing contact with the surface of the drum 1 (see FIG. 2) because the holder 11 has been pivotally moved in a direction opposite to arrow c, a clearance 14 having a predetermined size is formed between the blade 10 and the damper 13. The holder 11 is pivotably mounted on the blade support member 5 by a single support screw 15 screwed into the support member 5 through the center of the holder 11. Thus the blade 10 is pivotally movable with the holder 11 about the support screw 15 on the support member 5, whereby the cleaning edge of the blade is adapted to bear on the surface of the drum 1 uniformly along the length of the blade. A coil spring 7 is connected between a pin 4 fixed to the outer casing 2 and the outer end of a bolt 6 projecting from the support member 5 rightward in FIG. 1. The blade support member 5 is thus biased in the direction of arrow c about the pin 3 by the tension of the spring 7 acting in the direction of arrow d to hold the cleaning edge of the blade 10 in pressing contact with the drum surface. As a result, the end portion of the blade 10 is slightly warped upward. Preferably it is held in pressing contact with the drum surface at an angle $\theta$ of up to 90°, more specifically 60° to 90° (the angle being the angle between the blade 10 and the drum surface on the upstream side of the blade 10 with respect to the direction of movement of the drum 1). When the end portion of the blade is warped upwardly sufficiently to eliminate the clearance 14, the blade damping edge contacts the damper 13 and the blade cleaning edge is pressed against the surface of the drum 1 by the forward end of the holder 11 through the damper 13.

A toner collecting casing 20 has an upwardly open toner trapping channel 21 and is provided at its front side with the toner confining seal plate 23 which is made of a polyester film. The forward end of the seal plate 23 bears lightly on the drum surface. The toner trapping channel 21 extends alongside the drum 1 axially thereof and has the toner conveying coil 22 rotatably installed therein.

With the above arrangement, the toner remaining on the surface of the drum 1 driven in the direction of arrow a after the developing and transfer steps is scraped off by the cleaning edge of the blade 10. The vibration which tends to occur at the end portion of the blade at this time is absorbed and removed by the damper 13, which therefore substantially does not permit generation of vibration. The residual toner scraped off falls along the inner side of the seal plate 23 into the trapping channel 21, is transported to the developing unit via an unillustrated conveying pipe by the coil 22 driven in the direction of arrow b and is reused for developing latent electrostatic images.

Described in detail below are the conditions and results of an experiment which was conducted using this blade and blade holder arrangement.

(1) Blade

Material: Polyurethane rubber
Thickness (t1): 5 mm
Width: 330 mm (axially of the drum)
Length of projection (l1): 18 mm
Hardness: 73 degrees (JISA)
Angle of contact under pressure ($\theta$): 77°
Dissipation factor: $9\times10^{-2}$ (30° C.)
Force of pressing contact of cleaning edge: 5.2 g/mm (2) Damper Material: Polyurethane rubber
Thickness (t2): 3 mm
Width: 330 mm (axially of the drum)
Length (l2): 5 mm
Hardness: 65 degrees (JISA)
Dissipation factor: $4\times10^{-1}$ (30° C.)

(3) Clearance between blade and damper (a1): 1.57 mm

A running test was conducted using the above blade and damper, and it was found that the blade produced no vibratory noise during the making of 60,000 copies. It was also found that the damping of vibration diminishes the wear of the cleaning edge, assuring a satisfactory cleaning effect for a prolonged period of time, i.e. long enough for making as many as 60,000 copies. The same result as above was further achieved when the clearance (a1) was 1.50 mm. Incidentally, in a conventional apparatus having no damper, there was a frequent occurrence of vibratory noise and trouble developed in the cleaning due to wear of the cleaning edge after making only 20,000 copies.

The generation of vibratory noise by the above-described polyurethane rubber blade is closely related to the ambient temperature. It has been found that in the absence of the damper, vibratory noise starts to occur when the ambient temperature exceeds 40° C., whereas when the damper of the invention was used, no vibratory noise occurred even at an ambient temperature of 55° C.

Especially when a clearance is formed between the blade and the damper when the blade is out of contact with the drum, as in the present embodiment, the warp of the end portion of the blade can be effectively utilized for pressing the cleaning edge against the drum surface uniformly along the length of the drum. The clearance can be from 1.0 to 3.0 mm, preferably 1.3 to 1.7 mm. If it is less than 1.0 mm, the warp of the blade will not be effective for assuring uniform contact, and excessive torque will result from the rotation of the drum. If it is more than 3.0 mm, the angle of contact ($\theta$) is actually decreased by the pressing of the damper against the blade, failing to achieve a satisfactory cleaning effect.

To attain a good result, the damper should be made of a viscoelastic material, such as rubber, which has a greater dissipation factor than the material of the blade and a hardness of 30 to 85 degrees (JISA), optimally 40 to 60 degrees (JISA). The thickness of the damper should be at least 1.0 mm, optimally at least 3.0 mm.

Figure 5:
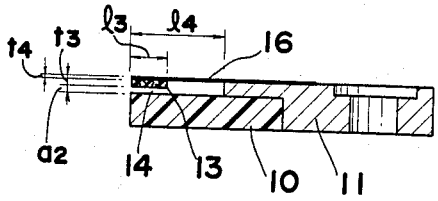
FIG. 5 is a sectional view similar to FIG. 4 showing a second embodiment of the blade holding member.

FIG. 5 shows a second embodiment wherein a flexible plate 16 is fixed at its one end to the upper surface of the holder 11. A damper 13 is affixed to the under side of the flexible plate 16 at its forward end. With the exception of this feature, the second embodiment has the same construction as the first.

Another experiment was conducted using the second embodiment under the following conditions with the results as given below.

(1) Blade

Same as in the first embodiment (2) Damper

Material: Polyurethane rubber
Thickness (t3): 1.5 mm
Width: 330 mm (axially of the drum)
Length (l3): 5 mm
Hardness: 65 degrees (JISA)
Dissipation factor: $4\times10^{-1}$ (30° C.)

(3) Clearance between blade and damper (a2): 0.5 mm (4) Flexible plate

Material: Phosphor bronze
Thickness (t4): 0.2 mm
Length of projection (l4): 18 mm The experiment revealed that the second embodiment achieves the same result as the first. The flexible plate, in particular, assists the damper in absorbing the vibration and warp of the blade and enables the damper to bear on the blade uniformly along the length of the drum.

A description will be given of the dissipation factor which is one of the conditions for the blade and the damper.

The dissipation factor is a damping effect indicator derived from a complex modulus. The damping effect can be expressed by the factor in almost all cases.

The complex modulus E* is given by $$E^*=E'+iE''=|E^*|\cos\delta+i|E^*|\sin\delta.$$

where $E'=|E^*|\cos\delta$: real part, $E''=|E^*|\sin\delta$: imaginary part, and $\delta$: phase angle between the stress and the strain.

The imaginary part is the part of the damping effect indicator which expresses the amount of energy dissipated as heat when a material deforms and is termed the loss modulus.

The dissipation factor is defined as E''/E' which is equal to tan $\delta$. Accordingly the greater tan $\delta$, the greater is the damping effect.

According to the present invention, it is preferable that the damper be made of a viscoelastic material having a greater dissipation factor than the material of the blade. However, since the dissipation factor varies with the hardness, the damper and the blade may be made of the same kind of material provided that they differ only in hardness.

Besides polyurethane rubber already mentioned, chloroprene rubber and various other viscoelastic materials can be used for the damper. There can also be used a metal having a high damping ability and which has strength as a metal and damping characteristics which are in conflict with each other. Such a metal is presently available under the brand name SILENTALLOY (product of Tokyo Shibaura Electric Co., Ltd.) and consisting essentially of Fe-Cr alloy and further incorporating various other elements.

While a high-damping effect metal can be used for the damper 13 of the first and second embodiment, a plate of this metal may be used in place of the flexible plate 16 in the second embodiment.

The damper 13 need not always be affixed to the holder 11. For example, the damper 13 may be affixed to the free end portion of the blade 10, and the holder 11 may be adapted to press on the portion of the blade 10 having the damper 13 thereon to substantially contact the damper 13 with the damping edge. Alternatively the damper 13 may be fixed to the casing of the cleaning apparatus. In this case, however, it is preferable to make the damper 13 movable with the blade 10 between the operative position and the retracted position since the blade 10 is pivotally movable about the pin 3, or to eliminate the means for pivotably supporting the blade 10.

Figure 6:
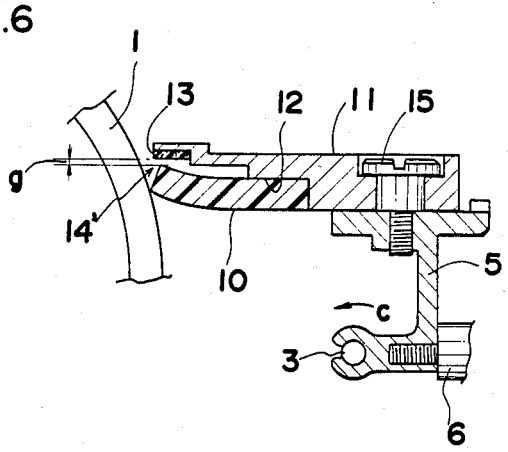
FIG. 6 is a view similar to FIG. 2 but showing the positions of the parts of the first embodiment when the cleaning apparatus is operated at a low ambient temperature.

Many experiments have been carried out with the first embodiment, and it has unexpectedly been found that with the polyurethane rubber blade of the first embodiment, unlike the second embodiment, a minute clearance 14' is formed between the blade 10 and the damper 13 as seen in FIG. 6 even when the cleaning apparatus is in operation, if the ambient temperature of the apparatus is at a relatively low level of 25° to 30° C. In other words, it has been found that in this temperature range, although the blade 10 is pressed against the surface of the drum 1 and thereby warped while the cleaning apparatus is in operation, the damper 13 remains out of contact with the damping edge of the blade 10.

It has further been found that for such a blade the clearance 14', i.e., the distance g between the blade and the damper 13, is dependent on, and varies with, the ambient temperature and is eliminated by a rise of the ambient temperature. Consequently it has been found that the first embodiment, when the polyurethane rubber blade is used, produces an outstanding effect because of the above feature, as will be described below with reference to FIGS. 7 to 9. The term "ambient temperature" refers to the temperature of the interior of the copying machine wherein the cleaning apparatus is incorporated, especially, the temperature in the vicinity of the cleaning apparatus. Usually the temperature readily rises to about 40° to 50° C. when the copying machine is in continuous operation.

Figure 7:
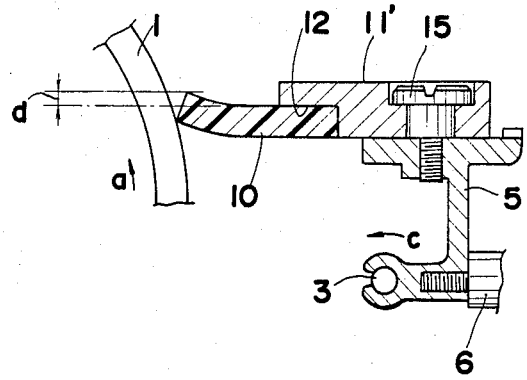
FIG. 7 is a view similar to FIG. 2 but showing a cleaning apparatus used for checking the property of the blade of the first embodiment.
Figure 8:
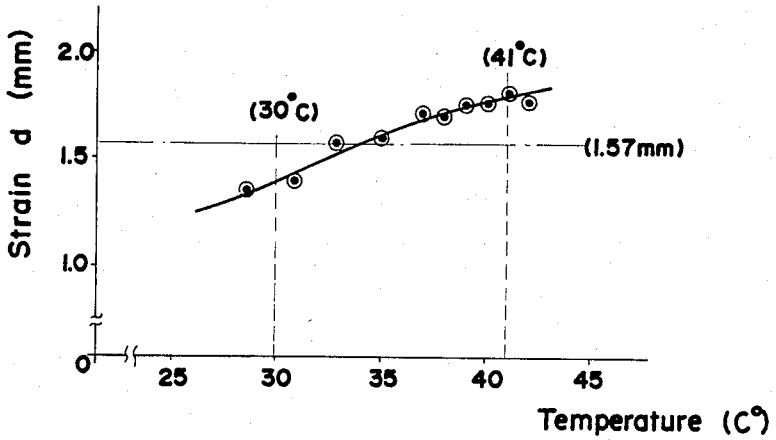
FIG. 8 is a graph specifically showing variations in the property of the blade dependent on the ambient temperature.

FIG. 7 shows a cleaning apparatus used for investigating the temperature dependent property of the polyurethane rubber blade 10 in the first embodiment. The apparatus has the same construction as the first embodiment except that the portion of the holder 11 of the first embodiment which holds the damper is removed to form a blade holder 11'. By the use of a dial gauge, the strain d of the blade 10 was measured which was produced during the operation of the apparatus, i.e., when the cleaning edge of the blade 10 was pressed against the surface of the drum 1 which was driven in the direction of arrow a. The measurements, which were made at various ambient temperatures, indicated that the strain d varies with the ambient temperature, as illustrated in FIG. 8. Analysis has revealed that the variation of the strain-temperature characteristic of the blade 10 is directly attributable to the fact that Young's modulus of the polyurethane rubber material of the blade 10 decreases with the rise of the ambient temperature.

As will be apparent from the variation of the strain of the polyurethane rubber blade 10, i.e. the strain d depends on the ambient temperature, as shown in FIG. 8, up to about 34° C. the value of the strain d is less than 1.57 mm, so that a clearance a1 will exist between the blade 10 and the damper 13. As a result, the damper 13 is not contacted by the blade 10. If the temperature rises above 34° C., however, the value of the strain d exceeds the size of the clearance a1, and this tendency becomes more pronounced with a further rise of the ambient temperature. Consequently, as the ambient temperature rises beyond 34° C., the damper 13 comes into increasingly more firm contact with the blade 10, thereby pressing the cleaning edge against the surface of the drum 1 to an increasing extent.

This brings about the result that the damping effect of the damper 13 on the end portion of the blade varies with the ambient temperature, and that the effect does not occur when the ambient temperature is below 34° C. This produces the following advantage of the cleaning apparatus.

It has been found that the polyurethane rubber blade 10 of the first embodiment does not generate a perceivable noise at ambient temperatures of up to about 40° C., even in the absence of the damper 13, but produces a pronounced noise when the ambient temperature rises above 40° C. In the first embodiment, therefore, the damper 13 is adapted to produce a damping effect on the edge of the blade 10 approximately at the time when the ambient temperature reaches 40° C. Further, it is most preferred that this effect be intensified with a further rise of the ambient temperature. Such a requirement on the damping of the blade 10 in the first embodiment is completely fulfilled by the foregoing effect achieved by the structure of the first embodiment. With the first embodiment, therefore, the vibration of the blade 10 can be prevented with an extremely high efficiency, and no noise is produced even if the ambient temperature reaches as high as 55° C.

Generally speaking, experience has shown that there is no need to provide any means for preventing the vibration of the polyurethane rubber blade 10 at an ambient temperature of up to 30° C., and further that, conversely, such a means is indispensable when the ambient temperature is 41° C. or higher. Insofar as the first embodiment is concerned, accordingly, it is desirable to give the clearance a1 a value such that the damper 13 is not contacted by the blade 10 when the ambient temperature is up to 34° C., that the damper is contacted by the blade from 34° C. to 40° C., but not with sufficient force to produce a good damping effect, and the blade is in proper contact with the damper when the temperature from 41° C. up so as to produce sufficient damping effect.

Figure 9:
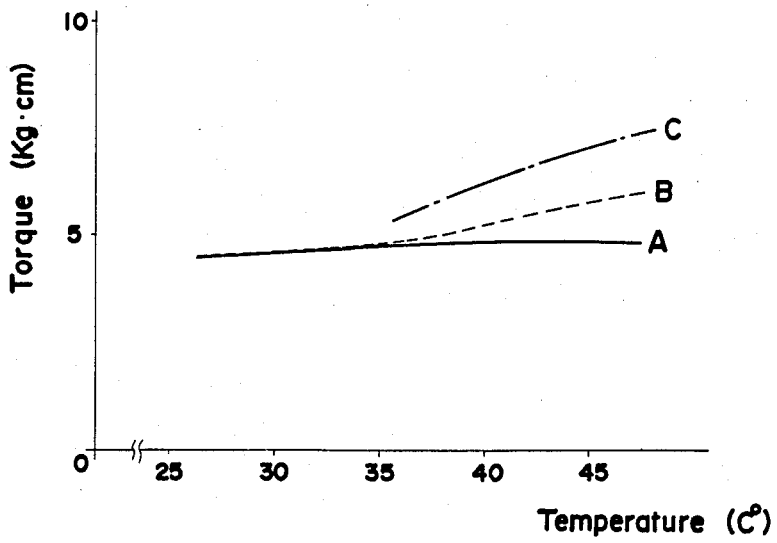
FIG. 9 is a graph showing the relation between the ambient temperature and the rotational drive torque of the photoconductive drum.

In connection with the foregoing result achieved by the structure of the first embodiment, the first embodiment has the advantage that the rotational torque for driving the drum 1 will not increase in excess of the desired level. The relation between the ambient temperature and the drive torque for the drum 1 is shown in the graph of FIG. 9, in which Curve A represents the relation for the cleaning apparatus of FIG. 7, Curve B the relation for the first embodiment with the dimensions and materials of the first experiment, and Curve C the relation for the first embodiment wherein the clearance a1 is 1.00 mm. When the clearance a1 is 1.00 mm, the damper 13 is contacted by the blade 10 almost as soon as the cleaning apparatus starts operation, irrespective of the ambient temperature. FIG. 9 shows that such contact of the blade 10 with the damper 13 causes a large increase in the drive torque of the drum 1. Thus, if the damper 13 is adapted to bear on the damping edge of the blade 10 when there is no need to prevent the vibration of the end portion of the blade, i.e., when the ambient temperature is low, the torque increases markedly with increasing ambient temperature as indicated by Curve C, whereas the increase of the torque is minimized as represented by Curve B when the gap of the first experiment is used. Insofar as the drive torque for the drum 1 is concerned, the cleaning apparatus shown in FIG. 7 is the most preferable, but the apparatus has no means for preventing occurrence of the vibration of the end portion of the blade so that the blade is permitted to vibrate without any suppression of the vibrations, thereby producing an unpleasant noise.

In summary, the cleaning apparatus according to the invention comprises a flexible cleaning blade retained by a holder, a support member supporting the holder for pivotal movement, a damper made of a vibration attenuating material, means for mounting the damper on the holder in spaced opposed relation to the end portion of the blade at a specified distance therefrom, and means for contacting the end portion of the blade the damper when pivotably biasing the support member to press the end portion of the blade into contact with the surface of the member to be cleaned and warping the blade itself, so that the vibration of the end portion of the blade is effectively prevented by the damper.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A blade cleaning apparatus comprising:

a cleaning blade having a free end portion for being held in pressing contact with a surface of a member movable past said cleaning blade and having residual toner deposited on the surface thereof which is to be removed therefrom;

holding means on which said blade is mounted for holding the end portion of the cleaning blade in pressing contact with the surface of the member to be cleaned for removing the residual toner from the surface;

a damper in spaced opposed relation to said end portion of said blade; and means for causing said damper and said end portion of said blade to be in contact with each other at a part other than the part of the end portion of the blade contacting the surface of the member to be cleaned for pressing the end portion of the blade against the surface of the member to be cleaned with a force sufficient to damp vibrations of the end portion of said blade which would otherwise cause the blade to produce noise.

2. A blade cleaning apparatus as claimed in claim 1, wherein said holding means is pivotable for moving said blade toward and away from the member to be cleaned.

3. A blade cleaning apparatus as claimed in claim 2, wherein said holding means is pivotally movable to a degree for, when the apparatus is out of operation, bringing the free end of said blade away from and out of pressing contact with the surface of the member to be cleaned.

4. A blade cleaning apparatus as claimed in claim 2, wherein said blade is mounted in said holding means and said holding means is positioned for holding the blade in pressing contact with the surface at an angle of up to 90° between the blade and the surface on the upstream side of the blade with respect to the direction of movement of the member to be cleaned.

5. A blade cleaning apparatus as claimed in claim 1, wherein said blade is made of elastic material and said means for causing said damper and said end portion of said blade to be in contact comprises means for holding said damper for being contacted with the blade end portion when the blade is warped by being pressed against the surface of the member to be cleaned.

6. A blade cleaning apparatus as claimed in claim 1, wherein said damper is made of a viscoelastic material having a greater dissipation factor than the material of the blade.

7. A blade cleaning apparatus as claimed in claim 1, wherein said blade is made of polyurethane rubber.

8. A blade cleaning apparatus as claimed in claim 7, wherein said damper is mounted on said holding means and the strain of the end portion of said blade in engagement with said member to be cleaned is dependent on and increases with an increase in ambient temperature of the portion of the cleaning apparatus in which the blade is positioned, said damper and said end portion of said blade being spaced from each other below said predetermined temperature and the increase in the strain being sufficient to bring said end portion and said blade into contact above said predetermined temperature.

9. A blade cleaning apparatus as claimed in claim 8, wherein when the ambient temperature is up to 34° C., the strain is insufficient to cause the end portion of said blade to contact said damper, and when the temperature is from 41° C. up the strain is sufficient to cause the end portion of said blade to be brought into contact with said damper with sufficient force to damp noise producing vibrations, and when the temperature is between 34° and 41° C. the strain is sufficient to cause the end portion of the blade to contact said damper but with a force insufficient to damp noise producing vibrations.

10. A blade cleaning apparatus comprising:

a flexible cleaning blade having a free end portion for being held in pressing contact with a surface of a member movable past said cleaning blade and from which residual toner deposited on the surface thereof is to be cleaned;

a holder on which said blade is mounted;

a support member on which said holder is mounted and which is pivotable toward the surface of the member to be cleaned for bringing the end portion of said blade in pressing contact with the surface of the member to be cleaned for removing the residual toner from the surface, and pivotable away from the member for spacing said blade from the member;

a damper made of vibration attenuating material and mounted on said holder and in spaced opposed relation to said end portion of said blade when said support member is pivoted away from the member to be cleaned; and means for biasing said support member toward the member to be cleaned for bringing said end portion of said blade into contact with the member to be cleaned for warping said end portion of said blade and bringing a part of said end portion of said blade other than the part contacting the surface of the member to be cleaned into contact with said damper with a force sufficient to damp vibrations of said end portion of said blade which would otherwise cause said blade to produce noise.

* * * * *